United States Patent [19]

Kriekels

[11] Patent Number: 4,667,482

[45] Date of Patent: May 26, 1987

[54] HEAT EXCHANGER DEVICE

[75] Inventor: Gaston Kriekels, Diepenbeek, Belgium

[73] Assignee: Anstalt für Metallbau, Vaduz, Liechtenstein

[21] Appl. No.: 769,544

[22] Filed: Aug. 26, 1985

[30] Foreign Application Priority Data

Aug. 29, 1984 [CH] Switzerland ..... 4206/84

[51] Int. Cl.[4] ..... F25B 27/00

[52] U.S. Cl. ..... 62/238.6; 62/238.7; 165/132; 165/74

[58] Field of Search ..... 62/238.6, 238.7

[56] References Cited

U.S. PATENT DOCUMENTS 2,375,157 5/1945 Wilkee et al. ..... 62/238.6 X
2,516,093 7/1950 Buff ..... 62/238.6 X
2,575,325 11/1951 Ambrose et al. ..... 62/238.6 X
4,487,032 12/1984 Speicher ..... 62/238.6 X
4,492,091 1/1985 Whitwell et al. ..... 62/238.6 X
4,492,093 1/1985 Schwarz ..... 62/238.6

FOREIGN PATENT DOCUMENTS

WO83/04088 11/1983 PCT Int'l Appl. .

*Primary Examiner*—Albert W. Davis, Jr.
*Assistant Examiner*—Peggy A. Neils
*Attorney, Agent, or Firm*—Walter H. Schneider

[57] ABSTRACT

In order to provide for a quick heating up of water in a container independently of its volume, a heat exchanger device comprises a container having a water inlet in a bottom section and a water outlet in an upper section as well as a heat transfer tube menas for conducting a heating fluid through said container. The heat transfer tube menas enter said container in said upper section and extend to a lower section so as to heat up the water in the upper section first.

8 Claims, 2 Drawing Figures

HEAT EXCHANGER DEVICE

BACKGROUND OF THE INVENTION

I. Field of the Invention

The invention refers to a heat exchanger device for heating up a liquid, which preferably is water, in a container or boiler. The container comprises heat transfer tube means, through which a heating fluid as e.g. steam, hot water from a central heating or freon from a heat pump is guided, and which transfer the heat of the heating fluid to the liquid in the container. The heat transfer tube means are e.g. coils of pipe having a big heat transfer surface.

II. Description of the Prior Art

Heat exchanger devices of the above kind are known e.g. from German publication No. 30 05 858. Such known heat exchanger devices need a relatively long heating up time, especially for containers of large volume, before the water temperature reaches the desired level of say 60° to 80° C. In the meantime the user has to content himself with water of lower temperatures. In order to eliminate this drawback efforts have been made to reduce the heating up time by a more efficient heating process as e.g. by induced liquid circulation within the container. However, the heating up time for big containers is still too long, which is especially disturbing if there is momentary need for little volumes of hot water.

SUMMARY OF THE INVENTION

Hence, it is a general object of the present invention to provide a heat exchanger device of the above kind, wherein the heating time can be reduced at least for a limited hot water volume independently of the volume of the container, so that after a short heating up time part of the container volume is at a temperature ready to be used.

A further object of the invention is to provide a heat exchanger device with an effective heat transfer from a heating fluid to the liquid to be heated.

Now, in order to implement these and still further objects of the invention, which will become more readily apparent as the description proceeds, the heat exchanger device is manifested by the features of comprising a container for said liquid having an inlet for said liquid in a bottom section and an outlet for said liquid in an upper section and further comprising heat transfer tube means for conducting a heating fluid through said container being arranged within the container in contact with the liquid to be heated up, said heat transfer tube means entering said container in said upper section and extending to a lower section of the container so as to heat up the liquid in the upper section first.

In a preferred embodiment of the invention said heat transfer tube means comprise a supply connection, an offtake tube and a conduit extending helically around said offtake tube from said supply connection to said lower section in said container, said offtake tube being heat insulated and extending from said lower section to said opening of the container. Preferably, said heat transfer tube means forms a unit, which is removably mounted to an opening of the container.

The invention allows the heating of liquids as e.g. of water in sections, such that in each section the extent of and the time necessary for heating up the liquid is determined by the respective shape of the heat transfer tube means in said section.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
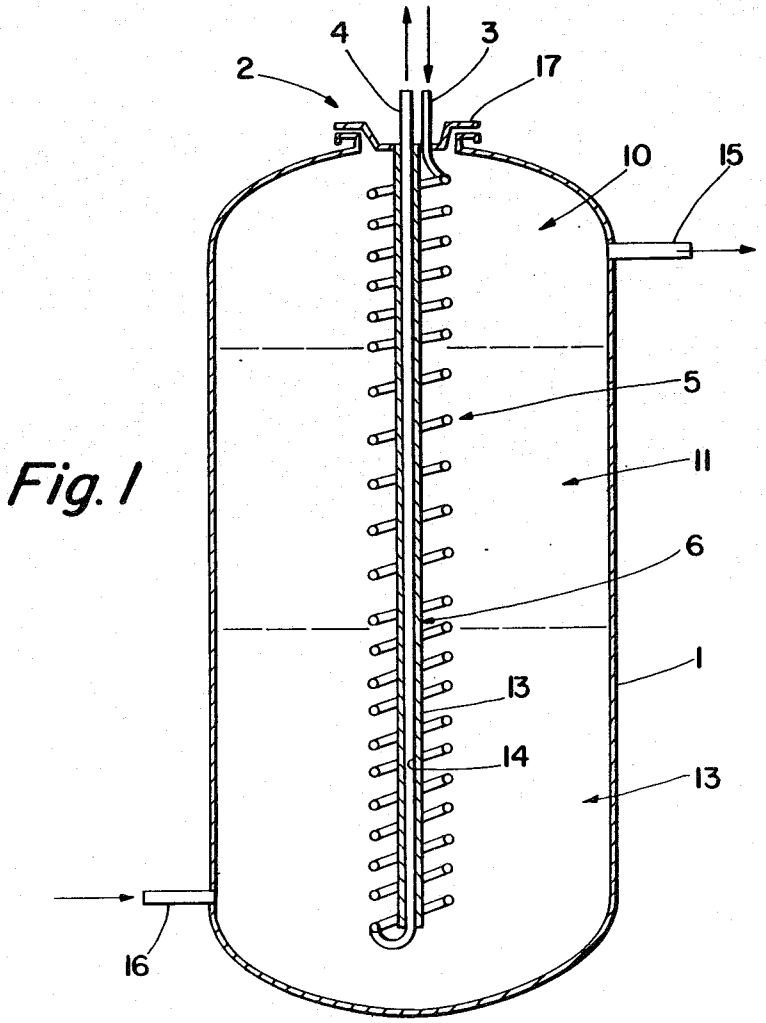
FIG. 1 is a first embodiment of the invention in sectional view.

In FIG. 1 a double-walled tubular container 1 is shown, which is mounted in vertical position and at its top has an opening 2, within which an inlet 3 and an outlet 4 of a closed circuit of heat transfer tube means is located, through which a heating fluid is guided. Said circuit comprises a heat transfer conduit 5, through which the heating fluid passes and an offtake tube 6, which is heat insulated against the surrounding liquid in the container. In the shown embodiment the heat transfer conduit 5 is a helical conduit with changing pitch. In an upper section 10 the helical conduit 5 has little pitch, i.e. a high number of turns per length. Therefore, the surface effective for the heat transfer from the heating fluid to the water in the container is relatively big in this section of the container. In addition, the heating fluid enters the container in this section and therefore has its highest temperature there. The water in the upper section 10 consequently will be heated with high efficiency and at first, so that the temperature of the water is raised quickly in this section. In the upper section 10, therefore, a stationary layer of hot water is formed, which is quickly ready for use. In a second, central section 11 of the container the helical conduit 5 has a smaller number of turns per length and a higher pitch. In a bottom section 12 the number of turn per length of the helical conduit increases again, so that the residual content of heat in the heating fluid is transferred with high efficiency to this coldest section 12 of water in the container.

At its bottom end the helical conduit 5 is connected to the insulated offtake tube 6. Therein the cooled down heating fluid is guided through the warmer water layers 12,11,10 back to the outlet 4 of the container 1. The offtake tube 6 comprises two coaxial pipes 13,14, the inner of which 14 holds the heating fluid. The space between said pipes 13,14 is filled with a heat insulating material as e.g. polyurethane. At the place, at which the inner pipe 14 is connected to the helical conduit 5, the inner and the outer pipe are joined by a flange to enhance the effect of the insulation and to protect the same. The outlet 15 for the heated water is located in the upper section 10 of the container adjacent to the quickly heated layer of water, whereas the inlet 16 for the cold water is located at the bottom of the container 1.

The shape of the heat transfer tube means needs not to be helical, as described above, but may have another shape providing heat transfer surfaces of suited extent so that an efficient heat transfer can take place. Since the heat transfer tube means can be formed from simple, straight tube elements, manufacturing as well as mounting of the heat transfer means is inexpensive. This is especially the case, if the heat transfer means form an integral unit with a lid 17, as shown in FIG. 1, which can be mounted to and removed from the container 1 as a whole, so that within the container 1, there are no connections.

Figure 2:
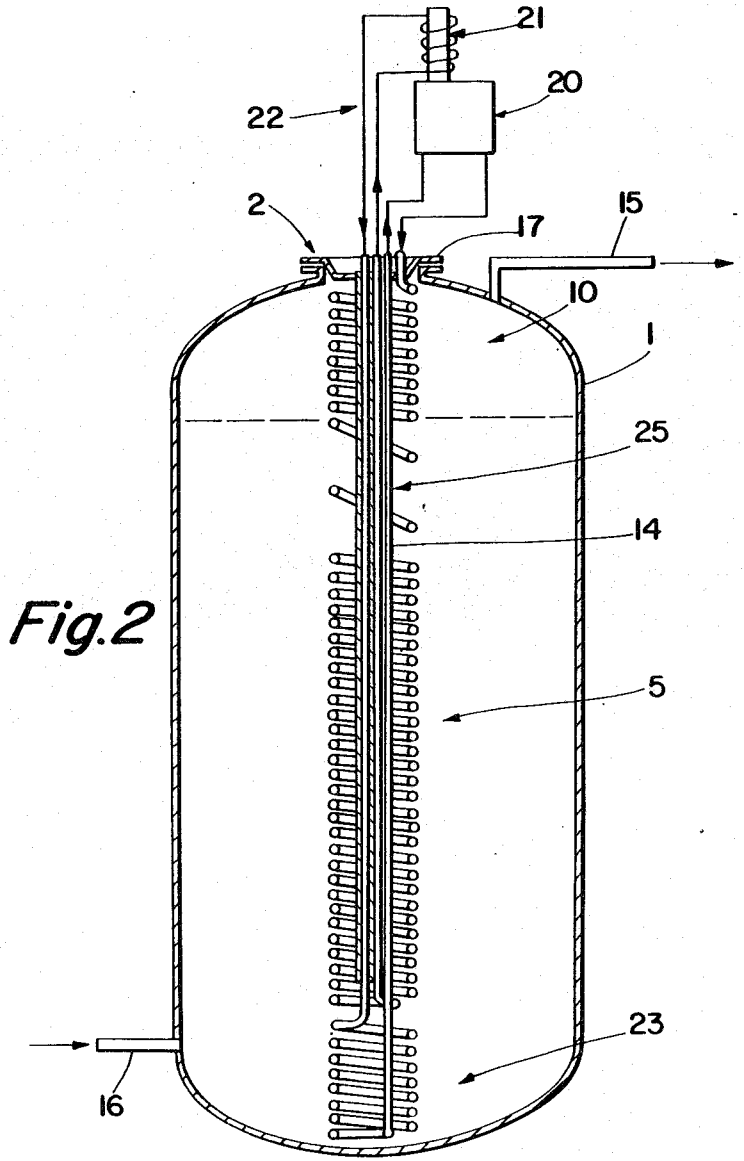
FIG. 2 is a second embodiment of the invention in sectional view, being connected to a heat pump.

Referring now to FIG. 2, a second embodiment of the invention will be described, which is provided for heating up water by means of a heat pump 20. The heat pump 20 of conventional type comprises a compressor 21, which is cooled by means of the (cold) heating fluid after its having passed the first heat transfer tube means 5 and being cooled down therein to a relatively low temperature level. Therefore, there are two heating circuits. The first one is formed by the first heat transfer tube means 5, through which the heating fluid from the heat pump 20 is guided. The second one is formed by the cooling circuit 22, 23 of the compressor 21, at which the heating fluid arrives after having passed the first one. In the second circuit 22,23 the heating fluid first is slightly heated up by the heat produced in the compressor 21 and then guided to second heat transfer tube means 23, which comprise a helical tube 23 located at the bottom section of the container 1. Since in the bottom section the water temperature in the container is relatively low compared with the upper sections, even the slightly heated heating fluid has a heating effect. For the supply and offtake of the heating fluid to and from said second heat transfer tube means 23, respective supply and offtake lines are arranged within a central unit 25, which also comprises the offtake tube of the first heat transfer tube means. The pipes in this unit 25 are insulated against each other, since they are on different temperature levels.

The described embodiment using a heat pump 20 and freon as heating fluid also provides for a layer of quickly heated water in the upper section 10 of the container, at which the heating fluid first enters the container and the helical heat transfer conduit has a little pitch and a high winding number. Thereby, the superheating phase in the freon circuit can be used effectively, so that in the upper section 10 higher water temperatures can be achieved, than in conventional devices.

In both embodiments the heat transfer tube means are arranged vertically from the top of the container 1. For bigger containers, of course, a plurality of such heat transfer tube units can be provided.

The described invention provides for an effective heat transfer and especially for a short term heating up of a part of the volume of the water in the container, which is quickly ready for use. The construction of the disclosed embodiments furthermore reduces the maintenance costs, since the heat transfer tube means are removable as a unit.

While there are shown and described present preferred embodiments of the invention, it is to be distinctly understood that the invention is not limited thereto, but may be otherwise variously embodied and practiced within the scope of the following claims.

What is claimed is:

1. In a heating device for heating a liquid comprising in combination a container for said liquid having lower and upper sections provided, respectively, with liquid inlet and outlet means; a heat exchanger for heating said liquid through heat exchange with a heating fluid; and a heat pump for heating said heating fluid having heating fluid inlet and outlet means and including a compressor having a cooling circuit comprising cooling circuit fluid inlet and outlet means, the improvement in which said heat exchanger comprises a first tubular means extending into the upper section of said container having one end connected to said heat pump heating fluid outlet means and the other end connected to said compressor cooling circuit fluid inlet means whereby said heating fluid heated in said heat pump exits therefrom and circulates through said first tubular means to heat said liquid in said upper section of said container and then enters said compressor cooling circuit as compressor cooling circuit fluid; and a second tubular means extending into the lower section of said container having one end connected to said compressor cooling circuit fluid outlet means and the other end connected to said said heat pump heating fluid inlet means whereby said compressor cooling circuit fluid heated in said compressor cooling circuit exits therefrom and circulates through said second tubular means to heat said liquid in said lower section of said container and then enters said heat pump as heating fluid.

2. The improvement according to claim 1 in which at least a part of each of said first and second tubular means is in the form of a helical conduit surrounding a common axis.

3. The improvement according to claim 2 in which the helical conduit forming the first tubular means comprises upper, intermediate and lower sections, the pitch of the helix of the intermediate section being greater than that of the upper and lower sections.

4. The improvement according to claim 2 in which each of the first and second tubular means further comprises an off-take line, the off-take line of the first tubular means connecting said helical conduit to said compressor cooling circuit fluid inlet means and the off-take line of the second tubular means connecting said helical conduit to said heating pump heating fluid inlet means.

5. The improvement according to claim 4 in which said off-take line of said second tubular means extends along the axis of the helical conduit of said second tubular means and together with the off-take line of said first tubular means extends along the axis of the helical conduit of said first tubular means.

6. The improvement according to claim 5 in which the off-take lines are heat insulated.

7. The improvement according to claim 5 in which said first and second tubular means are associated with a mounting plate to provide a unitary structure, said mounting plate being adapted to be mounted in a corresponding opening in the upper section of said container.

8. The improvement according to claim 1 in which said liquid inlet means of said container is connected to a supply of water.

* * * * *